United States Patent [19]

Sawvel

[11] 4,122,649

[45] Oct. 31, 1978

[54] COVER POSITIONING AND PLACEMENT DEVICE FOR SQUARE CONTAINERS

[76] Inventor: Thomas D. Sawvel, 10540 Ewing Ave. S., Bloomington, Minn. 55431

[21] Appl. No.: 816,485

[22] Filed: Jul. 18, 1977

[51] Int. Cl.[2] ..... B65B 7/28; B67B 3/22

[52] U.S. Cl. ..... 53/306; 53/314

[58] Field of Search ..... 53/290, 188, 296, 306, 53/297, 307, 313, 314, 315, 316, 329

[56] References Cited

U.S. PATENT DOCUMENTS

| | | | |
|---|---|---|---|
| 2,304,437 | 12/1942 | Bell | 53/315 X |
| 2,332,187 | 10/1943 | Allen | 53/188 |
| 2,734,673 | 2/1956 | Hazel et al. | 53/316 X |
| 2,942,395 | 6/1960 | Thoren | 53/316 |
| 3,261,142 | 7/1966 | Wilcox | 53/316 X |
| 3,408,789 | 11/1968 | Reddick | 53/315 |
| 3,460,314 | 8/1969 | Keas | 53/316 X |
| 3,477,199 | 11/1969 | Keas | 53/307 X |
| 3,495,252 | 2/1970 | Hamlin | 53/316 X |
| 3,908,340 | 9/1975 | Erhardt | 53/329 X |

*Primary Examiner*—Horace M. Culver
*Attorney, Agent, or Firm*—James R. Cwayna

[57] ABSTRACT

A positioning and placement device for the application of square covers to square containers which device basically includes a cover supply section for maintaining a supply of covers, a positioning and registration section to provide individual covers in proper relation to the square containers which are being moved thereunder and an application section which is arranged to remove the cover from the positioning and registration section and forceably engage the cover with a container as the same is being moved therepast in a manner to insure sealing therebetween on all edges thereof. The device particularly includes unique positioning and registration means for locating the covers with respect to the containers and unique placement means which not only forces the covers properly onto the containers but which also removes the covers from the registration and positioning section.

7 Claims, 10 Drawing Figures

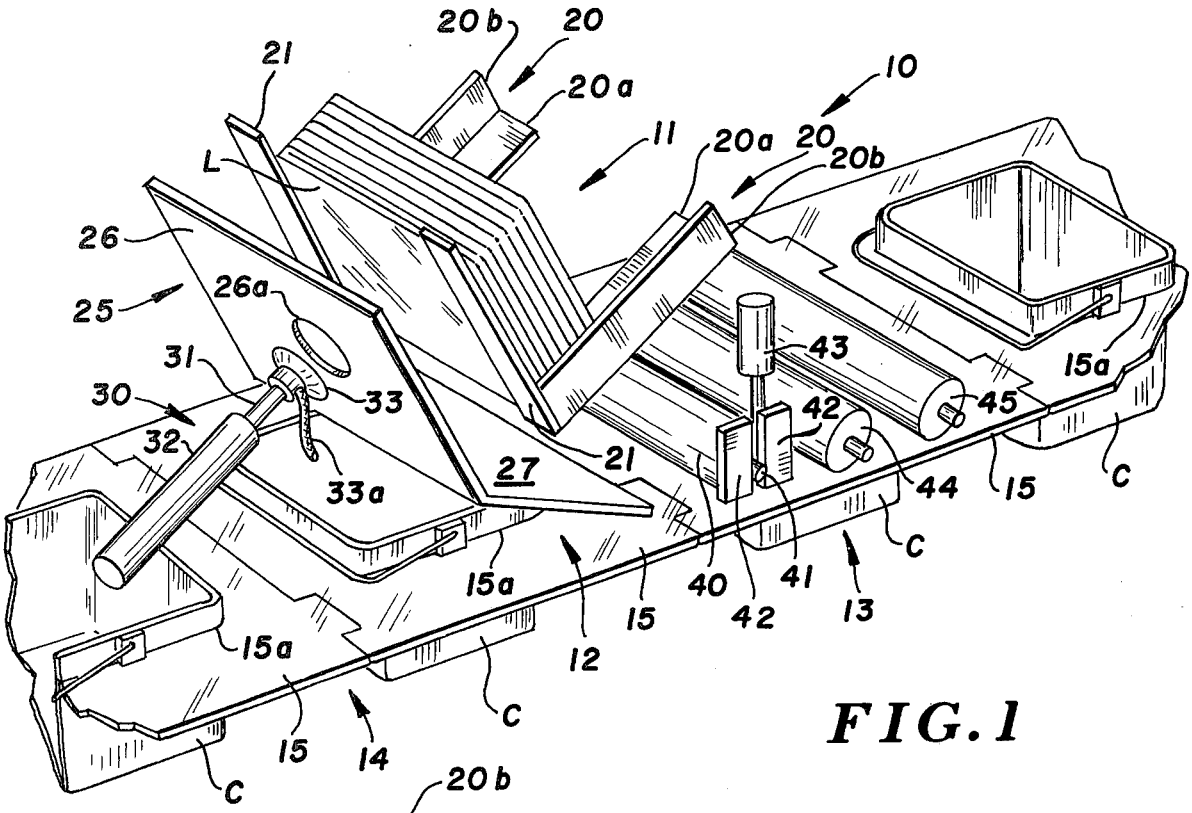
FIG. 1
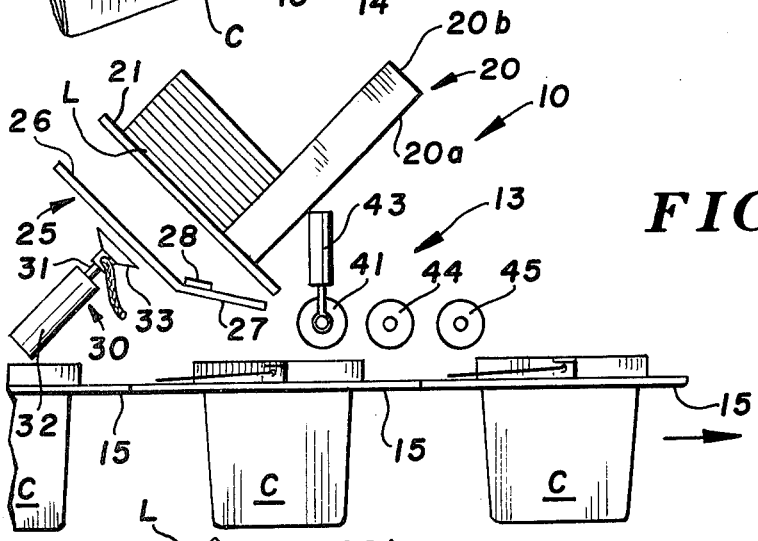
FIG. 2
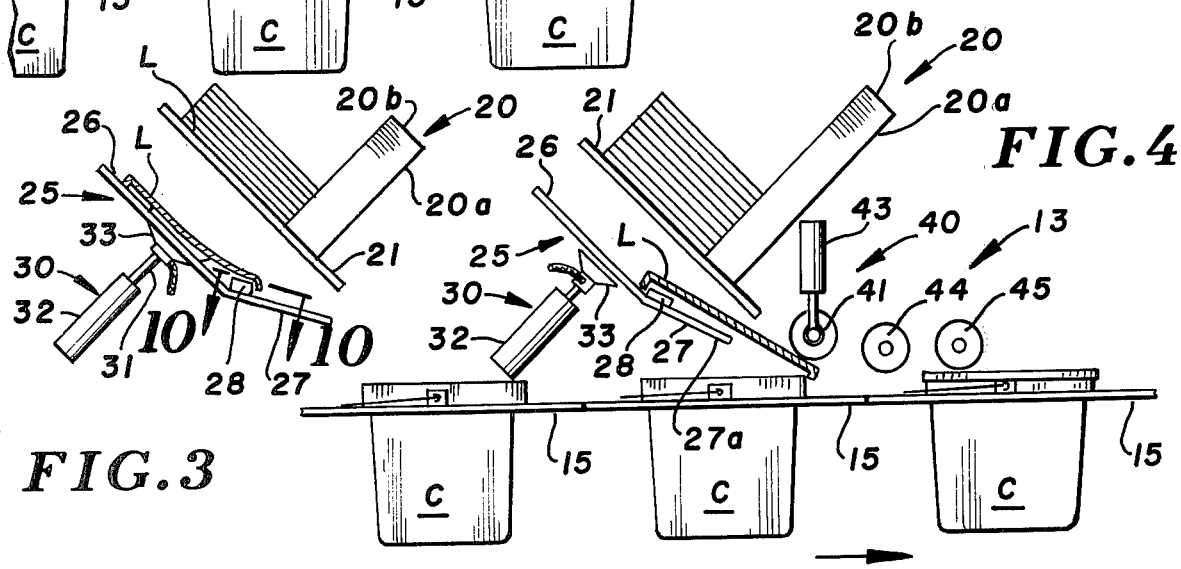
FIG. 4
FIG. 3

COVER POSITIONING AND PLACEMENT DEVICE FOR SQUARE CONTAINERS

FIELD OF THE INVENTION

This invention relates to machinery for the automatic placement of covers on filled containers, and more particularly to the placement to and sealing of square covers or rectangular covers upon square or rectangular containers.

BACKGROUND AND OBJECTS OF THE INVENTION

Devices for automatically placing covers upon filled round containers are generally known in the art. When covering round containers with round covers a self aligning situation results. The round cover, once it is placed on or against the upper edge of the container will normally self-locate upon the remaining portions thereof. When a square or rectangular cover is placed upon a square or rectangular container, it is essential that an entire edge of the cover be commonly registered with a first edge of the container. It is necessary for positive covering and sealing that the slightly rounded corners of the cover match the rounded corners of the container such that the sides of the cover will properly match the container, and correspondingly, the opposite edge of the cover will be properly received upon the pail. Any misalignment particularly of the first edge and corner will result in misplacement of the cover and this could result in shut-down of the machine.

It is an object of applicant's device to provide means of bringing a square or rectangular element into proper position for registration with a square or rectangular pail or container for placement of the cover such that an entire leading edge thereof is positively positioned on the container.

It is a further object of the applicant to provide a device for the placement of square or rectangular covers upon square or rectangular containers, which device includes the indexing of the cover with respect to a container being delivered therepast such that pressure being applied to an edge of the cover will result in deformation of the cover, to shift the same from an indexing element, such that the cover may be sequentially placed in sealed positions on the container.

It is a further object of applicant's invention to provide a device for automatically placing square or rectangular covers of a plastic material upon square or rectangular containers of a plastic material, which includes means for initially positioning at least one edge of the cover with respect to the container, thereafter interlocking the same with the container, and thereafter smoothly applying the remaining portion of the cover upon the container.

It is still a further object of applicant's invention to provide a device for attaching square or rectangular covers to square or rectangular pails or containers, wherein the cover elements include an exterior, continuous, downwardly depending lip and a continuous, downwardly depending inner lip to retain the upper edge of the container therebetween.

It is still a further object of applicant's invention to provide a device for attaching square or rectangular covers to square or rectangular pails or containers, wherein the cover elements include an exterior, continuous, downwardly depending lip and an intermittent, downwardly depending inner lip to retain the upper edge of the container therebetween.

It is still a further object of applicant's invention to provide a device for the automatic placement of square or rectangular covers upon square or rectangular containers which includes means for accommodating a cover design having at least one interior indexing pin, the device being provided with an indexing pin, and thus the cover associated therewith in proper relation to a square or rectangular container being delivered therepast, to provide for lateral placement of the cover with respect to the container.

These and other objects and advantages of the invention will more fully appear from the following description made in connection with the accompanying drawings in which the same numeral is used to designate the same or similar parts throughout the several views, and in which:

FIG. 1 is a perspective view of a section of a cover positioning and placement device embodying the concepts of applicant's invention, and illustrating a plurality of covers of a square or rectangular configuration in position, to be placed upon a square or rectangular container;

FIG. 2 is a side elevation of a portion of FIG. 1;

FIG. 3 is a view of a portion of FIG. 2, particularly illustrating the transfer of a single cover from a supply to a positioning ramp;

FIG. 4 is an elevation similar to that of FIG. 2, and in sequential relation to FIG. 3, and illustrating a suction release of a cover, and illustrating the cover in position against an indexing or positioning element;

Figure 5:
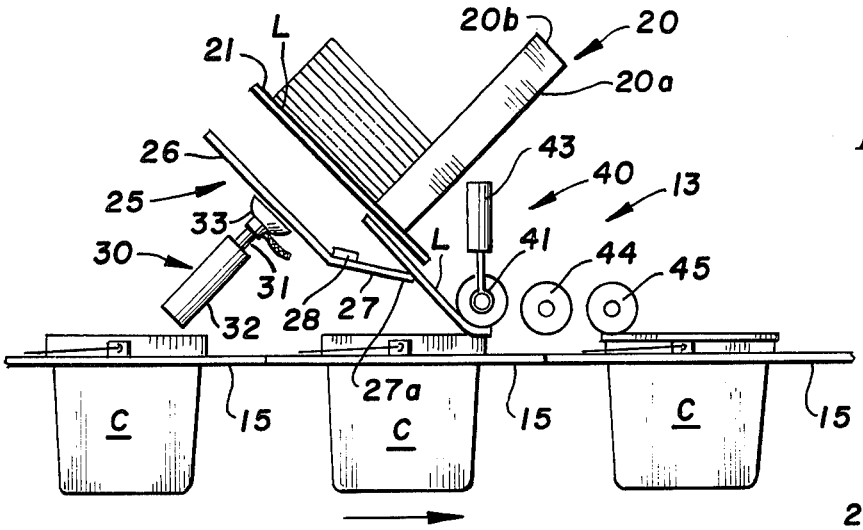
FIG. 5 is a sequential continuation of the view of FIG. 4, with the application of a first pressure roller against the cover, to position the same and place the same on the container and provide for its release from the registration element.

In accordance with the accompanying drawings, applicant's cover positioning and placement device is generally designated 10 and for clarity is broken down into a cover supply section 11, a positioning and registration section 12 and a cover application section 13. These various sections of applicant's device are all coordinated with respect to a conveyor flighting 14, which is designed to convey a plurality of square or rectangular containers C past a filling device (not shown) and past the cover positioning and placement device 10. The filling device is not illustrated, and is not pertinent to the invention.

The conveying device 14 normally consists of a plurality of flight elements, 15, mounted on two chains or hinged to one another to provide an endless carrier of such elements with apertures 15*a* provided therein, to normally receive and carry the containers of the specific form past the filling and covering stations. In the form shown, the apertures 15*a* are obviously of a square or rectangular configuration, to receive the container C therein, and the container C is normally provided with a shoulder, as illustrated in the Figures, or may be provided with other means for resting upon the upper surface of the individual flight elements 15.

The object of applicant's invention is, as stated, to provide a supply of properly sized and shaped cover members, which will be introduced into position for placement upon the individual containers, and sealed thereon, to seal the contents therein. Obviously, when working with the square or rectangular configuration it is essential that all, what may be termed edges of the cover, will coincide with the edges of the container. When working with round containers, there is a self-aligning situation, wherein the cover will conform or shift, to be in alignment with the container, but with square, or rectangular covers, this same self-aligning situation is not available, and therefore, a more close agreement must be provided for, prior to the attempt to place the cover upon the container.

In the form shown, the cover supply section 11 for the individual cover elements, which are individually referred to as L, consists of at least a pair of supporting guide members 20, which are illustrated as being in the form of angle brackets, having a lower 20*a* and a side 20*b* guiding surface. Covers L may be placed on the guides 20 and will be supported both from 20*b* and guided by the sides 20*a* and obviously these guides are positioned for substantial overlying correlation to the sides of the containers C that are passing therebelow. Stop elements 21 are provided at the ends of the angle brackets 20 to hold the lateral edges of the covers L. The angle guides 20 and the stop elements 21 should preferrably be adjustable as to the width therebetween and are preferrably arranged at an angular relationship with respect to the conveyor flight section 15 such that covers may be stacked therein and will, through gravity, move downwardly to be restrained by the stop member 21. With such a device, a supply of covers L may be positioned on this, what may be termed a loading bracket, for delivery to the remainder of the unit.

Arranged in spaced relationship from the stop elements 21 of the supply section 11, is a camming and ramping member designated in its entirety 25. This camming and ramping member consists of a first ramping plate member 26 arranged in spaced, parallel relation to the stop members 21 of supply section 11 having an aperture 26*a* therethrough to allow a cover retrieval element to pass therethrough. A second section of this camming and ramping member 25 consists of a second camming plate designated 27 which plate is arranged at an angular relationship to the stop element 21 and at an angular relationship to the first ramping plate member 26 and which is provided with a registration lug 28 thereon. This registration lug 28 may take several forms and for the purpose of the description to this point, it should be considered to be and operate as a stop element arranged to engage a downwardly depending lip of the cover L to temporarily retain the cover upon the positioning ramping surface 25 and more directly on the second plate 27 thereof.

The cover retrieval element is generally designated 30 and includes, in the form shown, a piston and cylinder combination designated respectively 31, 32 with the piston 31 being provided with a suction otherwise attachable element 33 on the extending end thereof, with connecting means 33a provided thereon for the control of air to the suction element 33 such that the piston 31 of the cylinder 32 may pass through the aperture 26*a* of the ramping plate 26, come into contact with the lower lid L which is resting against the stop members 21 of the lid supply unit and thereafter, the suction or grasping technique at the end of the piston 31 is actuated and the cover is temporarily adhered thereto to permit, upon withdrawal of the piston into the cylinder 32 the removal of the individual cover from the supply of such covers by bending the same and pulling it through the area between the stops 21.

Obviously, the situation and required suction, if vacuum is utilized, is dependent upon the shape and form of the cover, but these covers are normally resilient and will allow a single cover to be pulled through the stop elements 21.

Obviously the cylinder 32 and camming and ramping member 25 must be mounted in positive relationship to the cover supply section 11 and these elements may be mounted through various means, including an entire frame work to hold both the cover supply section and the positioning and registration section 12.

The retraction of the lid into position against the plates 26, 27 forming the camming and ramping member 25 in FIG. 3, wherein the lid is pulled downwardly against the angularly arranged plates 26 and 27, and at that time the suction is released from the cover L, and the piston 33 is further retracted through the plate member 26. The angularity and arrangement of the plates 26 and 27 and locating tab 28 is such that the cover L will have its lowermost edge below the tab 28 to be free to slide downwardly, until the inner uppermost edge of the cover L is positioned against the locating, registering tab 28. This particular situation is illustrated in FIG. 4, and to this point, although particular consideration is given to the cover construction, it should be sufficient to say that the cover will slide downwardly on the plate 26 and across camming plate 27 until the upper edge of the cover registers against the tab 28, thus stopping further progress of the lid L down the inclined plates. As illustrated in FIG. 4, the lower edge of the cover L will extend outwardly beyond the lower edge of camming plate 27, and will be in position above the normal traverse line of the containers C.

Figure 6:
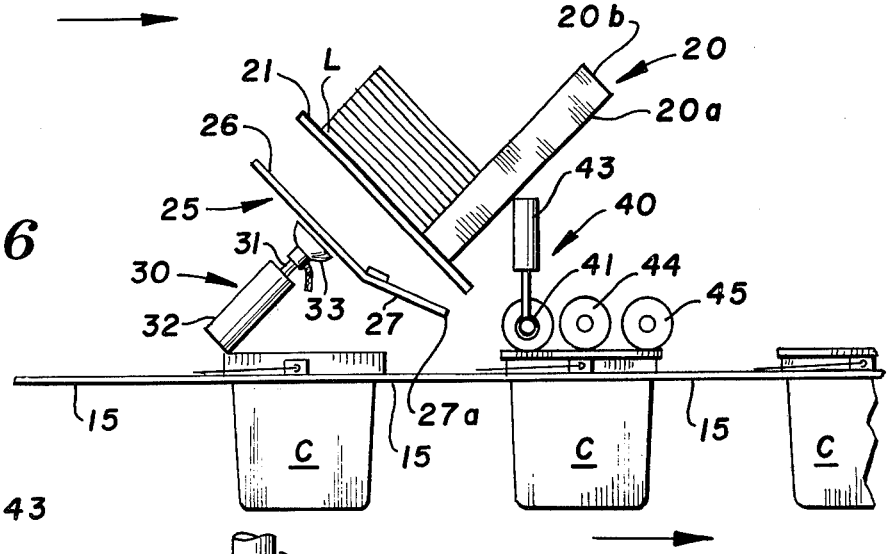
FIG. 6 is a sequential continuing view from FIG. 5, illustrating the application and further pressurization of the cover element by a plurality of roller elements as the container and cover unit is moved therepast.

At the advancement of the container C, the first pressure roller and application section 13 is brought into operation. The sequential operation of the same is best illustrated in FIGS. 4, 5 and 6. As previously discussed, the cover L upon engagement with the registration lug 28 extends beyond the camming plate 27 into position where it is slightly above the top of the containers C as they pass therebelow. As a container comes into position below the leading edge of the cover, its position is sensed and a first pressurizing or pressurized cylinder designated 40 comes into operation to force the edge of the cover L downwardly into registration with forward edge of the container. This roller section, and particularly this first roller 40, is a pressure operated roller, which extends across the width of the conveying system, and the ends, thereof, 41, are provided for vertical movement within a pair of bearing blocks 42, or the like, is arranged to actuate the cylinder for its upward or downward motion. Such pressurizing means 43 must either be provided on both ends of the roller member 40, or a single such pressurizing unit could be utilized to actuate both ends of the roller 40 to urge the same uniformly downwardly against the cover L to force the same onto the containers C.

The entire application section 13 consists of a plurality of spaced roller units, and may include two additional rollers 44, 45 which are in position to normally abut with the upper surface of the cover when the same are on the containers to insure that the covers are positively sealed against the upper lip and upper surfaces of the container.

Again, it should be noted that no particular mounting means are provided for these rollers, including first shiftable roller 40, but it should be obvious that these must be rotatably mounted, to permit the cover and container to pass therebeneath without creating undue friction, and that they must be of such a size and spacing to properly assist in seating the cover upon the container. Also, though the applicant has illustrated three such rollers, it should be obvious that the primary pressure roller 40 could accomplish the total function, and that these additional rollers are only to insure proper seating of the lid upon the container.

As illustrated in FIG. 6, it is desirable in many cases to maintain pressure upon both the front and rear cover edges at one time, and therefore the pressure cylinder 40 is illustrated in its downward stroke, and the same is held in such position entirely during the movement of the container such that it will contact what is termed the rear edge of the cover while one roller 45 of the set is contacting the opposite or front edge of the lid. With the width of the rollers being sized to cover the transverse dimension of the cover, pressure then is obtained on all surfaces of the cover.

The operation of the unit to this point should be obvious. The containers carried by the individual flight sections 15 are moved past a filling device and the same are filled with the desired material. This filling technique is extraneous to the aspects of applicant's invention. The cover placement and positioning mechanism, including the cover supply, the cover placement and positioning element, and the pressurized roller situation are arranged in what may be termed downstream location from the filling device. Covers are sequentially transferred from the cover supply by the cylinder-piston attachment or grasping element, and are positioned upon the ramping and camming unit 25, and released from the grasping element 33, such that the covers will slide downwardly and abut with the registration lug 28. It should be noted, and should be obvious, that by properly positioning the side guides 20 of the cover supply unit, the covers will normally be provided against this registration lug with their sides in normal registration to the sides of the containers upon which they are to be placed. At this point, container C is indexed, its position sensed, and when the container is in underlying, vertically spaced position to the edge of the cover L, the pressure cylinder 40 is actuated and is moved downwardly. A uniqueness of applicant's device lies in the arrangement of the camming plate 27 and lug 28 arrangement with respect to the movement of such cylinder, in that the downward movement thereof will cause a snap release, as comparatively shown in FIGS. 4 and 5 wherein the downward force of roller 40 will force one edge thereof downwardly into sealing relationship against the container and the cover through its tendency to stay in its normal flat configuration, will be snapped upwardly against the edge of camming plate 27 to allow escape from the locating, or registrating lug 28 into a position as illustrated in FIG. 5 where it is guided upon and rests upon the lower surface **27*a* of the camming plate 27 where the same may be pulled therefrom by the continued movement of the container to the right with its edge being captured upon the edge of the container. It is this snap release concept that is of import to the invention. The registration lug 28 insures proper location of the frontal edge of the cover and the downward pressure of the piston 40 releases the cover from the registration lug 28**.

Further movement of the container C will, through the pressure of the rollers, draw the lid from the edge **27*a* of the camming plate 27 and seal on the upper surface of container C. The actuation and position of the rollers 44, 45** or additional rollers will positively seal the cover L on the container C.

It should be obvious that this indexing, registration lug 28 is designed to be received internally of a cover element L. This operation, in conjunction with the pressure cylinder 40 is illustrated for one form of the cover in FIGS. 7 and 8. It should be noted that the cover element L, in this case, has a continuous, exterior, downwardly extending lip K spaced from a continuous, inner, downwardly extending lip M spaced from the outer lip K to receive the upper surface S of the container. Hooking elements may be provided on the interior periphery of the lip K for positive locking of the cover L to the container but it should be noted that the cover is not dropped down in position to abut with the container, but rather is spaced therefrom and is held therefrom by the angularity of the camming plate 27 the length of the cover, and the registration lug 28 and that the cover is only brought into locking registration with the container through the downward extension of the pressure roller 40. In FIG. 8, this downward extension is illustrated, and this downward pressure of the roller 40 causes a certain deflection of the cover L which, due to the placement of the lower edge **27*a* of the camming plate 27 will cause the cover to be shifted from contact with the registration tab 28 such that the cover L may be further retracted from camming plate 27. For this reason, it should be noted that the registration lug 28 must be positioned with respect to the cover supply so that it will not engage with the lower edge of the cover but rather be received therein and allow the cover to slide downwardly to camming plate 27**, and thereafter, to engage the upper edge or upper interior edge of the cover L.

Figure 7:
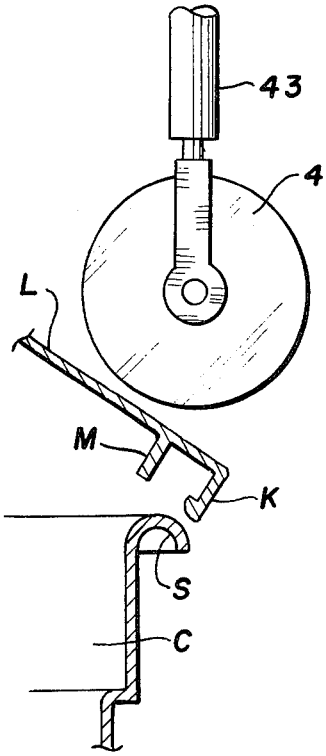
FIG. 7 is a side elevation illustrating the position of the container, the cover and the pressurizing roller prior to actuation of the pressurizing roller.
Figure 8:
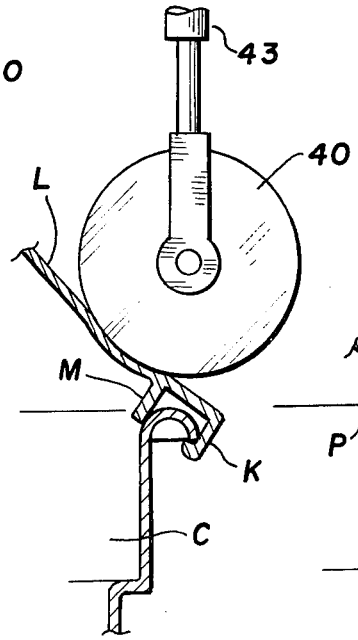
FIG. 8 is a view similar to FIG. 7, and illustrating the position of the container, cover and the pressure roller, when the roller is in position to press the cover to the container.
Figure 9:
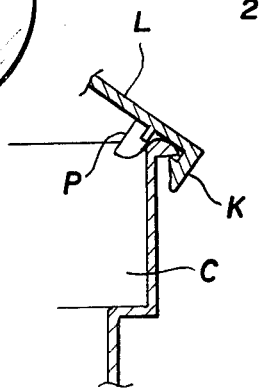
FIG. 9 is a view similar to FIG. 8, with the elimination of the pressure roller, and illustrating the cover pressed to the container, with a modified form of the container and cover being illustrated; and, FIG. 10 is a view taken substantially along line 10—10 of FIG. 3, illustrating the indexing or cover location element having an indexing detent.
Figure 10:
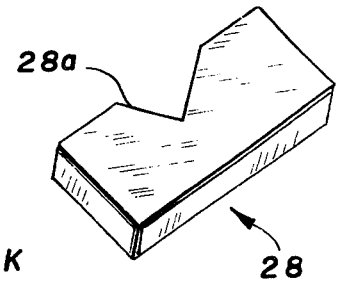

FIGS. 7 and 8 are applicable to cover elements which have interior lip sections M which are continuous or which consist of a plurality of spacedapart, indexing tabs entirely around the inner portion of the cover L, but the applicant has concerned himself with a more positive element for insuring centering and lateral locating of the covers with respect to the container upon which they are to be placed. A particular indexing lug is illustrated in FIG. 10, and this indexing lug consists of an element having a V-shaped or other guiding indexing area **28*a* on the upper surface thereof, such that, if for example, a cover having a series of spaced tabs around the interior thereof is utilized, one of these spaced tabs will be received in the detent and thus laterally center the cover. This type of registration lug would be most usable with a cover device which particularly is designed with a single indexing, locating pin as shown in FIG. 9 and designated P therein, designed to be received into the detent 28***a* of the lug 28.

The necessity for the interior lip on a square container should be obvious. When utilizing a cylindrical or round container, the container develops its own strength due to its shape, and when filled, is not easily distorted. A square container must provide rigidity even when filled, and for this reason, the cover section must be provided with a capturing, sealing device on the inner surface thereof to grasp and retain all of the sides or edges of the container. In order to accomplish this, the inner lip M and outer rim K, or in the case of applicant's design, K and P, must be provided for proper sealing of the cover to the container to maintain such rigidity.

With applicant's device, a unique mechanism is provided for the introduction of square or rectangular covers for the placement thereof onto square or rectangular containers. The cover members are initially held in general orientation to the flow of containers therebelow and are extracted singularly from the supply to position the same upon a gravity flow mounting arrangement which includes an indexing element for properly locating one end of the cover with respect to containers to be covered. The downward pressure of the pressure rollers forces the lower extending edge of the cover to the container, thus releasing the cover from the locating lug. At least one pressure roller, that which has caused the cover to be shifted from the locating detent, will insure sufficient pressure to force the cover onto the container, but a plurality of such rollers may be provided to further insure the locating of the cover onto the container.

It should be obvious that applicant's invention provides a new and unique device for the placement of square or rectangular covers onto square or rectangular containers where the alignment between the units may not be derived strictly from the shape itself but which requires a pre-determined orientation for proper operation.

What I claim is:

1. A device for automatically positioning and placing generally rectangular covers on generally rectangular containers including:

a. a cover application section for positively positioning a generally rectangular cover onto a generally rectangular container received into said section;

b. a cover supply section including means for retaining a plurality of covers in a supply position;

c. a positioning and registration arranged intermediate said supply section and said application section, said positioning and registration section including a first ramping plate arranged in parallel, spaced relation to said cover supply section and a second camming plate arranged angularly to said ramping plate and said application section, whereby a cover may be transferred to said ramping plate and will slide therefrom onto said camming plate;

d. transfer means arranged to select a single cover from said supply and transfer the same to said positioning and registration section;

e. positioning and registration means provided at a selected portion of said camming plate arranged to contact and receive a portion of a cover delivered thereto from said ramping plate and retain the same thereon with a portion of the cover extending into said application section and positioning the cover in spaced relation to the cover receiving portion of a container received into said application section;

f. application means provided in said cover application section arranged to forceably shift the extending portion of the cover into sealed relation with the container and simultaneously shifting the cover from said positioning and registration means to permit the cover to be removed from said positioning and registration section; and, g. means for moving the container and cover past said application means whereby the entire cover is sealed to the container.

2. The structure set forth in claim 1 and the length of said camming plate and the position of said positioning and registration means being determined thereon to permit one extending edge of the cover to extend beyond the end of said camming plate.

3. The structure set forth in claim 2 and said camming plate being arranged with respect to a container received in said application section to position the extending edge of the cover above the container.

4. The structure set forth in claim 2 and said positioning and registration means including at least one detent receiving surface to receive a locating member of the cover.

5. The structure set forth in claim 1 said positioning and registration means arranged to contact an inner portion of the cover and said application section including first roller means for applying pressure to and shifting the cover from spaced relation with respect to the container to a sealing position on the container.

6. The structure set forth in claim 5 and sensing means arranged for actuation of and movement of said roller into shifting contact with the cover when a container is received into said application section in position to receive the cover.

7. The structure set forth in claim 5 and said first roller means being held in pressure applying relation to the cover and container as the same is moved therepast.

* * * * *